United States Patent [19]

Minami et al.

[11] Patent Number: 4,468,033

[45] Date of Patent: Aug. 28, 1984

[54] OBJECT TRANSFER TOY UTILIZING GEARS FOR COMPONENT COORDINATION

[75] Inventors: Koichi Minami; Tohru Nishimiya, both of Tokyo, Japan

[73] Assignee: Tomy Kogyo Co., Inc., Japan

[21] Appl. No.: 417,330

[22] Filed: Sep. 13, 1982

[30] Foreign Application Priority Data

Sep. 14, 1981 [JP] Japan ..... 56-136597[U]

[51] Int. Cl.[3] ..... A63F 9/08

[52] U.S. Cl. ..... 273/153 S; 273/117

[58] Field of Search ..... 273/153 S, 110, 281, 273/117; 46/43

[56] References Cited

U.S. PATENT DOCUMENTS

| | | | |
|---|---|---|---|
| 636,109 | 10/1899 | Bowers | 273/153 S X |
| 908,410 | 12/1908 | Jensen | 273/153 S |
| 2,095,046 | 10/1937 | Wilner | 273/153 R |
| 2,199,327 | 4/1940 | Ahrens | 273/121 A |
| 2,477,441 | 7/1949 | Cole . | |
| 3,172,666 | 3/1965 | Ryan . | |
| 3,193,293 | 7/1965 | Schaper . | |
| 3,592,471 | 7/1971 | Swimmer | 46/43 X |
| 3,655,194 | 4/1972 | Pierson . | |
| 4,058,317 | 11/1977 | McCarthy . | |
| 4,395,041 | 7/1983 | Goldfarb et al. | 273/153 S X |

OTHER PUBLICATIONS

A. C. Gilbert Co., Catalog, 1966, p. 6.

*Primary Examiner*—Anton O. Oechsle

*Attorney, Agent, or Firm*—K. H. Boswell; Edward D. O'Brian

[57] ABSTRACT

A toy game of skill has a housing and a plurality of members rotatably mounted on the housing such that they are in operative association with one another. One of the members is rotated, and in so rotating that member, the rotation is communicated to the rest of the members to simultaneously rotate them. Located on the members are a plurality of object repositories. A plurality of objects, at least one less than the number of object repositories, are positioned within the object repositories. As the members move with respect to one another, the objects are carried on the object repositories. The objects can be transferred from one repository to an empty repository when two of the members are in a position aligning their respective object repositories with one another. However, the objects are retained in any one object repository whenever the members are in a position with respect to one another such that the object repositories are not aligned.

7 Claims, 3 Drawing Figures

10
30
30
30
52
114
50
114
112
32
46
26
76
74
36
32
16, 18, 20, 22 & 24
100
102
98
34
32
14
70
28
68
66
56
58
48
116
86
96
60
62
84
94
92
72
12
82
80
116
78
88
64
54
90

OBJECT TRANSFER TOY UTILIZING GEARS FOR COMPONENT COORDINATION

BACKGROUND OF INVENTION

This invention is directed to a game of skill whereby a plurality of objects can be moved interchangeably between a plurality of object repositories located on a plurality of members which are in association with one another. More specifically, the invention is directed to a game wherein a group of members in a symmetrical array are coded with respect to the plurality of objects such that the codes between the objects and the members can be rearranged in a game of skill.

There are a plurality of U.S. patents which have been issued directed to games which incorporate gear mechanisms and the like. For the most part, these patents are directed to teaching the interaction of gears and the transfer of power via them. Typical of such patents would be U.S. Pat. Nos. 4,058,317; 3,193,293; 2,095,046; 3,172,666 and 2,477,441. At least with respect to U.S. Pat. No. 2,095,046, the disclosure of the patent utilizes the gear arrangement to form a puzzle mechanism. For the most part, the other patents listed above are directed to simply teaching the interrelationship of gears and similar mechanisms.

In a second type of device illustrated in U.S. Pat. No. 3,655,194, a game apparatus is described in which a plurality of rotors are spaced in an aligned position with respect to one another on a board. Each of the rotors includes arcuate shaped sections removed from the rotors. The arcuate shaped sections provide for elongated spaces between adjacent rotors. A plurality of playing pieces of flat, ovaloid, or football-type, shape, fit into the cutout sections of the rotors and can be moved along the playing board by positioning the playing piece tightly against one of the rotors and rotating the playing piece in conjunction with rotation of the rotor. Of course, the playing piece must be moved into a voided area located between two rotors. In this game, the rotors are independent of one another, and rotation of one does not rotate a second one, and, in fact, rotation of a second, adjacent rotor would be inhibited with respect to rotation of a first rotor, because it is necessary for the arcuate surface of the second rotor to remain static and allow the playing piece to slide along this arcuate surface as the first rotor and the playing piece are moved with respect to the second rotor. Because of this feature, one does not disturb previously positioned playing pieces in moving subsequent playing pieces.

Recently, a series of games have been introduced, such as Rubik's Cube and the like, wherein it is the object of the game to rearrange a set of surfaces into a predetermined sequence and wherein movement of one surface concurrently moves at least another surface. Because of the concurrent movement of the other surface, an element of complexity is introduced into the game which is both challenging and has considerable play value.

It is believed that, in view of the concurrent movement which can be achieved with a series of gear trains, there exists a need for a game which concurrently moves a series of members via a gear train or the like, and incorporates a puzzle element wherein movable portions of the puzzle element do not remain static, but move with each and every move of any of the members controlled by the gear train.

BRIEF DESCRIPTION OF THE INVENTION

In view of the above, it is a broad object of this invention to provide a game outlined in the previous paragraph. It is a further object to provide a game that is both entertaining and challenging, and simple to use. It is a further object to provide a game which, because of its engineering principles and method of construction, is susceptible to ease of manufacturing, thus rendering the game economical for the consumer, yet is durable in use, thus providing a long and useful lifetime.

These and other object, as will become evident from the remainder of this specification are achieved in a toy which comprises: a housing; a plurality of members each movably mounted on said housing with each of said members in operative association with at least one other of said members; means associated with at least one of said members for moving that member; interconnecting means on each of said members interconnecting said members such that movement of said one of said members is communicated to the other of said members whereby said members move in association with respect to each other; each of said members including at least one object repository means located on said member; a plurality of objects, the number of said objects being at least one less than the number of said object repository means, each of said objects capable of being held by one of said object repository means as said member on which said object repository means is located is moved on said housing; said members located on said housing and moved with respect to one another by said interconnecting means such that at least one object repository means on each of said members which are in operative association with each other are in a first instance aligned with one another allowing transfer of an object between said aligned object repository means and in a second instance not aligned with one another preventing transfer of an object between said non-aligned object repository means.

In a preferred embodiment of the invention, each member would be operatively associated with at least two other of the members. Further, each of the members would include a plurality of object repository means located thereon and the interconnecting means would comprise gear means located on each of the members.

In the illustrative embodiment as illustrated herein, each of the members is circular in shape and is rotatably mounted on the housing with the gear means of each of the members intermeshed with the gear means on the other members operatively associated with it. The repository means would comprise openings in the periphery of the circular members and preferredly each of the members is in operative association with at least three other of the members. Additionally, the object repository means are mounted in a symmetrical array on the periphery of the members.

In the illustrative embodiment, the members are arranged such that some of the members are in a polygonal array surrounding the remaining portion of the member. For the illustrative embodiment, seven members are utilized with six members being positioned in a hexagonal array around the seventh of the members. The objects are spherical objects and are equal in number to one less than the number of object repository means, such that at any one time, one object repository means remains vacant, holding no object therein, while the remainder of the repository means each has an object therein.

Preferredly, the means for moving one of the members would include an additional gear train, at least a portion of which is exposed on the housing such that it can be manipulated by the digits of the user of the game and upon manipulation of said portion, this additional gear train rotates one of the members, which in turn rotates the remainder of the members in association with it.

BRIEF DESCRIPTION OF THE DRAWINGS

This invention will be better understood when taken in conjunction with the drawings wherein.

This invention includes certain principles and/or concepts as are set forth in the claims appended to this specification. Those skilled in the toy arts will realize that these principles and/or concepts are capable of being illustrated in a variety of illustrative embodiments differing from the exact illustrative embodiment utilized herein. For this reason, this invention is not to be construed as being limited to the illustrative embodiment depicted herein, but is only to be construed as being limited by the claims.

DETAILED DESCRIPTION OF THE INVENTION

Figure 1:
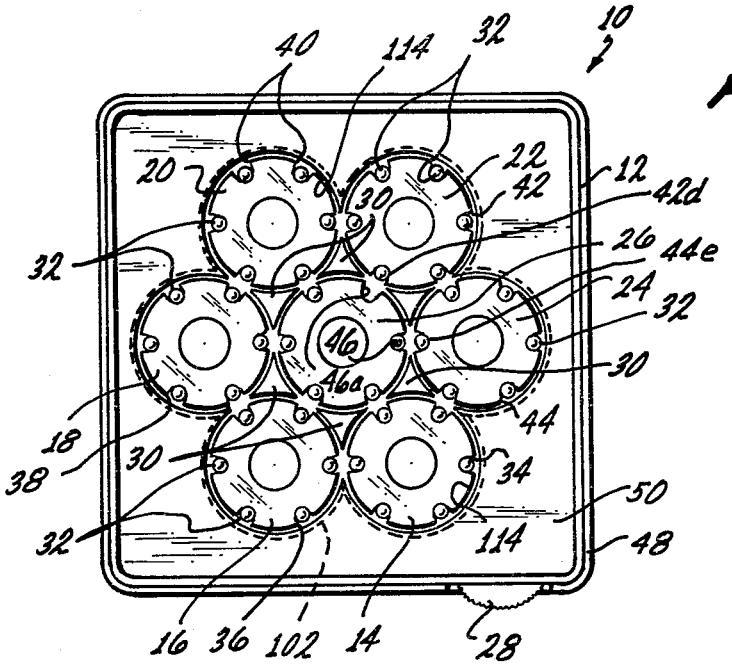
FIG. 1 is a plan view of an illustrative embodiment of the invention.
Figure 2:
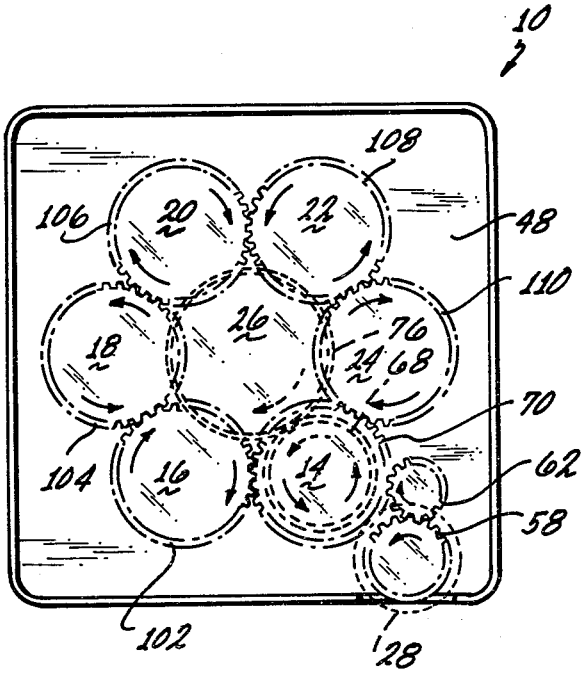
FIG. 2 is a plan view of the toy of FIG. 1 with certain overlying components removed to illustrate the interaction of underlying components thereof.

In FIG. 1, the toy 10 of the invention is shown as it would be utilized by the player of this toy. The toy 10 includes a housing 12 which, in the illustrative embodiment, includes seven circular members 14, 16, 18, 20, 22, 24 and 26. The circular members 14, 16, 18, 20, 22 and 24 are arranged in a hexagonal shaped array with the central circular member 26 located in the midst of all of the remainder. Projecting out of the bottom edge of the housing 12 is a knurled knob 28. Five small triangular shaped guides, collectively identified by the numeral 30, are seen interspaced between the members 14, 16, 18, 20, 22, 24 and 26. A plurality of objects, collectively identified by the numeral 32 are seen located on the members 14, 16, 18, 20, 22, 24 and 26.

Each of the members includes a plurality of object repositories, collectively identified by the numeral 34 for the member 14, the numeral 36 for the member 16, the numeral 38 for the member 18, the numeral 40 for the member 20, the numeral 42 for the member 22, the numeral 44 for the member 24 and the numeral 46 for the member 26. In the illustrative embodiment of the figure, six object repositories are located on each of the respective members. A total of forty one objects are shown for the toy 10 in the drawings, with one of the object repositories, repository **46*a*, on member 26, being vacant, not having an object 32** located therein.

During play with the toy 10, it is an object to rearrange the individual objects 32 with respect to the positions within the circular members 14, 16, 18, 20, 22, 24 and 26, by moving one of the objects 32 from one of the members, such as from member 20, illustrated in FIG. 1, to an adjacent member, such as member 26, illustrated in FIG. 1, wherein the object repository **46*a* is empty and can accept the objects 32. This then voids the repository 42*d* such that it can now accept an object 32. The knurled knob 28 is rotated, which, as explained below, causes rotation of all of the members 14, 16, 18, 20, 22, 24 and 26 on the housing 12 and repositions the object repositories 34, 36, 38, 40, 42 and 44 and 46 with respect to one another, such that object repository 42*d*, upon counterclockwise movement of member 22, becomes positioned next to object repository 44*e*, upon concurrent clockwise movement of member 24, allowing for passing of the object located in object repository 44*e* to the object repository 42*d* on member 20 upon realignment of the members 20 and 24** with respect to one another. In this same manner, objects can be transferred back and forth between members wherein one of the members includes an empty object repository.

Normally, in the preferred embodiment of the toy 10, certain of the members 14, 16, 18, 20, 22, 24 or 26, and certain of the objects 32 would be color coded such that on scrambling of the color coded objects 32, the user of the toy 10 is then challenged to reposition them in their proper positions complying with the original color coding. For example, members 14, 18 and 20 could could color coded to three individual colors, green, blues, red or the like, while the remaining members 16, 22, 24 and 26 could be color coded to a fourth color. All of the objects originally positioned on member 14 would be coded with the same color as member 14; likewise for members 18 and 20 with the second and third colors, and also for the remaining members with a fourth, common color. In this form of utilization of the toy 10, there is one less object 32 than there is the totality of the object repositories 34, 36, 38, 40, 42, 44 or 46. The remaining repository on any of the members 14, 16, 18, 20, 22, 24 or 26, at the beginning of the game would preferredly contain one of the objects 32 which is color coded to the four members sharing a common color. It is also conceivable to have other forms of the game where more of the object repositories 34, 36, 38, 40, 42, 44 or 46 would be empty, and there would be even fewer of the objects 32 compared to the total object repositories.

For the preferred embodiment as illustrated by the toy 10, six of the circular members 14, 16, 18, 20, 22 and 24 are spaced in a polygonal array, more specifically a hexagonal array, around the seventh of the members, members 26. Other arrangements could be made, with the minimum criteria being that any one of the members 14, 16, 18, 20, 22, 24 or 26 need touch, at a minimum, one of the other members, such that it is possible to transfer an object 32 between adjacent object repositories on any two adjacent members.

Figure 3:
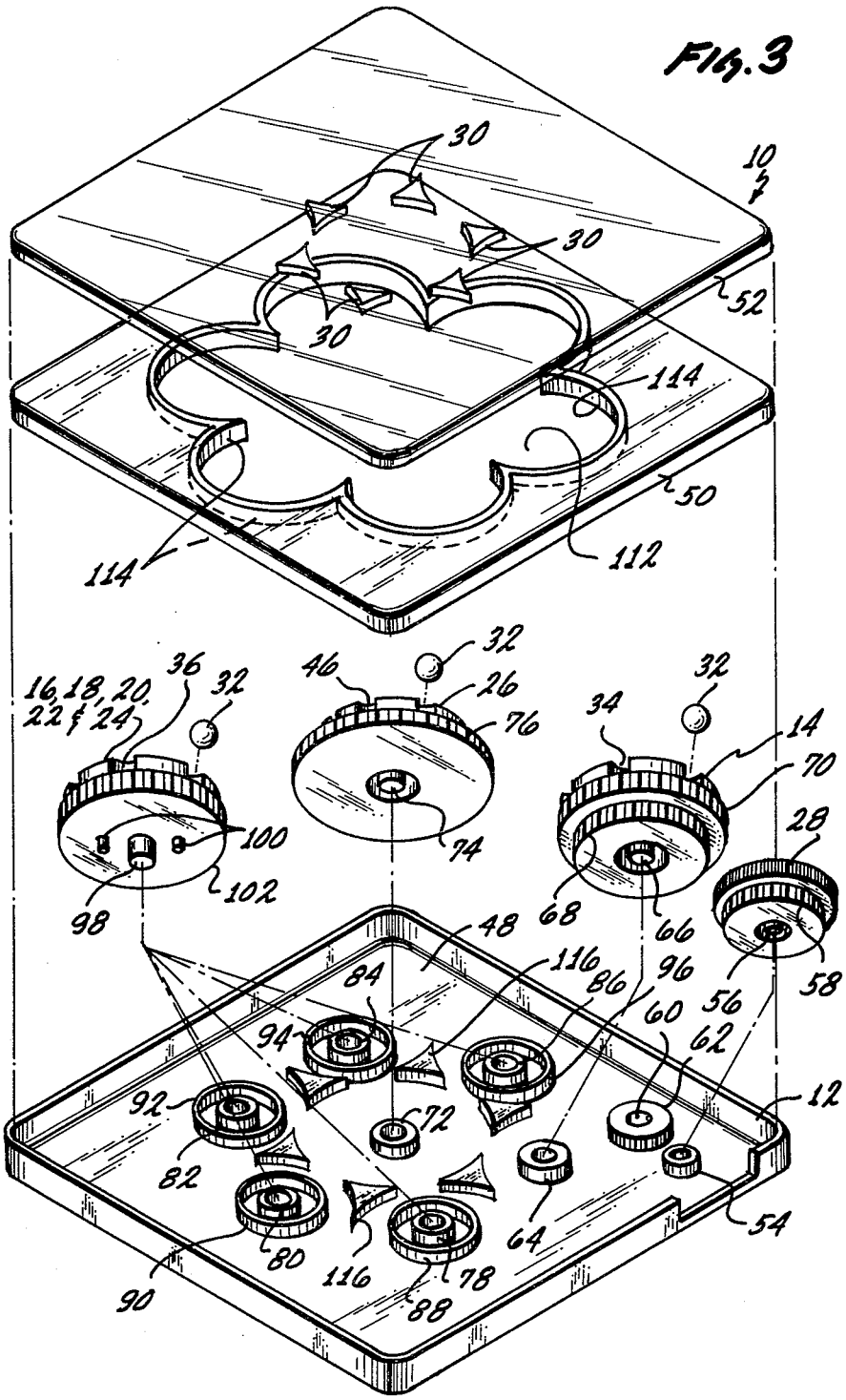
FIG. 3 is an exploded view of the toy illustrated in FIG. 1 showing interaction of the components of the invention.

Referring now to FIG. 3, it can be seen that the housing 12 is made up of three component parts, a bottom housing 48, a central insert 50 and a cover 52. The cover 52 is transparent, allowing for viewing through it of the members 14, 16, 18, 20, 22, 24 and 26 and the objects 32 below. The guides 30 are formed as an integral portion of the cover 52 and project downwardly towards the bottom housing 48. Thus, the triangular shaped guides 30 which can be seen through the transparent cover 52 in utilizing the toy 10 are actually formed in a molding operation as part of the transparent cover 52 and project downwardly from its inside surface. Since the guides 30 are formed as a part of the cover 52 on its inside surface, when the cover 52 is positioned on the bottom housing 48, the guides 30 project downwards and are positioned in between the members 14,16,18,20,22,24 and 26.

Also formed on the bottom housing 48 is a boss 54 which serves to mount the knurled knob 28 onto the bottom housing 48. The boss 54 is hollow such that it can accept an axle 56 formed as a part of the knurled knob 28 which projects downwardly and fits within the boss 54. The knurled knob 28 includes gear teeth 58 formed thereon.

Located adjacent to the boss 54 is an upstanding axle 60 which projects upwardly from the bottom housing 48. Fitting around axle 60 is a gear 62. The gear 62 intermeshes with the gear 58 on the knurled knob 28 and thus the gear 62 is rotated with respect to rotation of the knurled knob 28.

Positioned upwardly and to the left of the axle 60 is a second hollow boss 64. Member 14 includes an axle 66 formed on its underneath surface which fits into and is accepted by the boss 64. Thus, the member 14 is rotatably mounted to the bottom housing 48 by the interaction of the axle 66 within the boss 64. The member 14 includes gear teeth 68 which mesh with the gear 62 and thus rotation of the knurled knob 28 is transferred by the gear 62 to the member 14. The member 14 also includes a second set of gear teeth 70, whose function will be explained below.

A third hollow boss 72 is formed in the center of the bottom housing 48. This third hollow boss accepts an axle 74 which is formed on the underneath side of the central circular member 26. The member 26 includes gear teeth 76 formed around its periphery which mesh with gear teeth 68 on member 14, thus rotation of member 14 is transferred to member 26, rotating member 26 in unison with member 14. Guides collectively identified by the numeral 116 serve to keep member 26 centered on boss 72.

Five other bosses, 78,80,84 and 86 also project upwardly from the bottom housing 48. Surrounding each of these bosses 78,80,82,84 and 86 are upstanding annular rings 88,90,92,94 and 96.

Each of the members 16, 18, 20, 22 and 24 are identical, and all of them include an axle 98 located on their bottom surface and two projections collectively identified by the numeral 100 are also located on their bottom surface and radially displaced the same distance from the axle 98. In FIG. 3, member 16 is illustrated showing these features. The remainder of the members 18, 20, 22 and 24 are exactly as member 16 in FIG. 3. The appropriate axles on the respective members 16, 18, 20, 22 and 24 fit into appropriate bosses 78, 80, 82, 84 or 86 and the projections 100 fit within the appropriate annular ring 88, 90, 92, 94 or 96 to rotatably mount the members 16, 18, 20, 22 and 24 to the bottom housing 48.

The member 16 includes gear teeth 102 around its periphery. The member 18 includes gear teeth 104 around its periphery. Likewise, for members 20, 22, and 24 with regard to gear teeth 106, 108 and 110, respectively. When the members 16, 18, 20, 22 and 24 are appropriately rotatably mounted to the bottom housing 48, their respective gear teeth intermesh. Thus, the gear teeth 102 on member 16 mesh with the gear teeth 104 on member 18. The gear teeth 104 on member 18 mesh with the gear teeth 106 on member 20 and the gear teeth 106 on member 20 mesh with the gear teeth 108 on member 22. Furthermore, the gear teeth 102 on member 16 mesh with the gear teeth 70 on member 14, as do the gear teeth 110 on member 24. Rotation of member 14 is thus transferred via gear teeth 70 to member 16 and member 24 simultaneously, and these two members are further included in the circular gear train which also includes gears 104, 106, and 108 on members 18, 20 and 22, respectively. Thus, during play of the toy 10, upon rotation of the knurled knob 28 in one direction, members 14, 18 and 22 will turn in a first direction, and members 16, 20 and 24 will turn in the opposite direction and vice versa. Member 26, because it meshes with member 14, turns in the opposite direction that member 14 is turning, and thus it turns in the direction that members 16, 20 and 24 are turning.

As can be seen in FIG. 3, the object repositories 36 on member 16 are formed as an opening in the periphery of the circular shape of member 16 on that area directly over the gear teeth 102. The gear teeth 102 provide a bottom support surface on the bottom of the object repository 36 which holds the objects 32 suspended on the member 16. Of course, the object repositories 38, 40, 42, 44 and 46 on the other members are formed in the exact same manner.

The central insert 50 includes an opening 112 which fits around the outside perimeter of the respective members 14, 16, 18, 20, 22 and 24. The opening 112 is surrounded by a wall 114 which mimics the shape of the opening. The wall 114 forms a confinement surface to maintain the objects 32 in their respective object repositories 34, 36, 38, 40, 42 and 44 as the members 14, 16, 18, 20, 22 and 24 are rotated. The wall 114 in conjunction with the guide 30 maintains the objects 32 in the object repositories in all instances except when two object repositories are aligned with one another and one of the object repositories is empty, allowing for transfer of an object 32 from one repository to another, as explained above. Thus, in all instances when one of the members 14, 16, 18, 20, 22, 24 or 26 are being rotated, any object 32 located in one of the respective object repositories located thereon will be maintained in that object repository. The cover 52 serves as the uppermost portion over each of the object repositories and prevents the objects 32 from lifting vertically from them.

It is evident that in using the toy 10, because of the interlock of the members 14, 16, 18, 20, 22, 24 and 26 by the gear means provided thereon, in all instances wherein one of the members 14, 16, 18, 20, 22, 24 or 26 is rotated, the remainder of the members also rotate. This complicates the use of the toy 10 and once the objects 32 which are color coded are mixed up on the particular members, much skill and thought must be utilized in rearranging them in proper coded sequence, because of the simultaneous rotation of all of the members.

I claim:

1. A toy which comprises:

a housing;

a plurality of members each movably mounted on said housing, said members positioned in an array so as each of said members is in operative association with at least three others of said members, each of said members being circular in shape and positioned with respect to one another such that the peripheries of each of said members which are in operative association with each other are positioned adjacent to each other at a tangent point;

gear means located on each of said members with the gear means on any one of said members intermeshed with the gear means on at least one other of said members such that movement of one of said members is communicated to the remainder of said members so as all of said members move in association with one another;

additional gear means intermeshed with one of said members with a portion of said additional gear means exposed from said housing in a position such that it is capable of being manipulated by the digits of a user of said toy so as to rotate said one of said members on said housing with the rotation of said one of said members communicated by said gear means to the remainder of said members so as to rotate all of said members in association with one another in response to said manipulation of said additional gear means;

each of said members including a like number of object repository means located thereon in a symmetrical array around the periphery of the members;

a plurality of objects one less than the total number of object repository means located on all of said members, one each of said objects located in each of said object repositories with one object repository vacant at any specific instance in time;

an object repository on one of any two respective associated members being aligned with an object repository on the second of said two respective associated members at their respective tangent point at a specific point of rotation of said two respective associated members and not aligned with each other at all other points of rotation;

an object capable of being transferred from the respective object repository it is located in to said vacant object repository only when said vacant repository and said respective object repository are aligned at the particular point of rotation of the two associated members on which said vacant repository and said respective repository are located.

2. The toy of claim 1 wherein:

a portion of said plurality of said members are arranged in a polygonal array around the remaining portion of said members.

3. The toy of claim 2 wherein:

said objects are spherical in shape.

4. The toy of claim 3 including:

seven of said members with six of said members being positioned in a hexagonal array around the seventh of said members.

5. The toy of claim 4 wherein:

said gear means on each of said members on said six of said members in said hexagonal array intermesh with the gear means on each of their adjacent members and the gear means on the seventh of said members intermeshes with the gear means on one of said six members.

6. The toy of claim 5 wherein:

each of said members includes six of said object repository means located thereon.

7. The toy of claim 6 wherein:

said objects are divided into groups with the objects of each group being of a different color than the objects of the other groups.

* * * * *